US007692383B2

(12) United States Patent
Satomi

(10) Patent No.: US 7,692,383 B2
(45) Date of Patent: Apr. 6, 2010

(54) EL PANEL

(75) Inventor: Noriaki Satomi, Tokyo (JP)

(73) Assignee: TDK Corporation, Tokyo (JP)

( * ) Notice: Subject to any disclaimer, the term of this patent is extended or adjusted under 35 U.S.C. 154(b) by 421 days.

(21) Appl. No.: 11/709,055

(22) Filed: Feb. 22, 2007

(65) Prior Publication Data

US 2007/0262700 A1 Nov. 15, 2007

(30) Foreign Application Priority Data

Feb. 28, 2006 (JP) ..... P2006-054030
Feb. 28, 2006 (JP) ..... P2006-054032

(51) Int. Cl.
*H01J 63/04* (2006.01)

(52) U.S. Cl. ..... 313/512

(58) Field of Classification Search ..... 313/512
See application file for complete search history.

(56) References Cited

U.S. PATENT DOCUMENTS 6,489,719 B1 * 12/2002 Young et al. ..... 313/512
2003/0062533 A1 * 4/2003 Yee et al. ..... 257/99

FOREIGN PATENT DOCUMENTS

| | | |
|---|---|---|
| CN | 1617637 A | 5/2005 |
| JP | A-11-224772 | 8/1999 |
| JP | A-2002-260849 | 9/2002 |
| JP | A-2003-317942 | 11/2003 |
| JP | A-2005-079056 | 3/2005 |
| JP | A-2005-091874 | 4/2005 |
| JP | A-2005-322432 | 11/2005 |

* cited by examiner

*Primary Examiner*—Toan Ton
*Assistant Examiner*—Hana A Sanei
(74) *Attorney, Agent, or Firm*—Oliff & Berridge, PLC

(57) ABSTRACT

EL panels having a longer life are provided. The EL panel according to the present invention contains a substrate; an EL element formed on the substrate; a sealing plate facing the substrate and covering the EL element on the substrate; and an adhesive interposed between the substrate and the sealing plate and containing multiple plate-shaped or needle-shaped fillers, wherein a projection and depression part is formed on a contact area of the substrate with the adhesive, and on a contact area of the sealing plate with the adhesive, and one ends of the fillers are inserted in a depression part of the projection and depression part.

4 Claims, 16 Drawing Sheets

*Fig.15*

| HOUR (h) | SAMPLE #1 (47%) | SAMPLE #2 (53%) | SAMPLE #3 (72%) | SAMPLE #4 (88%) |
|---|---|---|---|---|
| | BRIGHTNESS ($cd/m^2$) | BRIGHTNESS ($cd/m^2$) | BRIGHTNESS ($cd/m^2$) | BRIGHTNESS ($cd/m^2$) |
| 0 | 150 | 150 | 150 | 150 |
| 6 | 70 | 124 | 139 | 148 |
| 12 | 62 | 102 | 136 | 147 |
| 24 | 50 | 100 | 134 | 145 |
| 48 | 45 | 99 | 131 | 140 |
| 72 | 42 | 96 | 130 | 140 |
| 96 | 45 | 93 | 128 | 139 |
| 120 | 48 | 91 | 127 | 137 |
| 240 | 27 | 86 | 126 | 135 |
| 480 | 28 | 81 | 126 | 134 |
| 1000 | 27 | 79 | 125 | 135 |
| LOWERING RATE OF BRIGHTNESS (%) | 82 | 47 | 17 | 10 |

EL PANEL

BACKGROUND OF THE INVENTION

1. Field of the Invention

The present invention relates to an EL panel.

2. Related Background Art

EL (Electro Luminescence) elements such as organic EL and inorganic EL are included in a selfluminous type light-emitting element, which has a characteristic that it is easy to make it smaller and lighter, as well as a high brightness, and therefore the EL elements are expected to be applied to displays, illuminations, and the like. Luminescent materials used for these EL elements, however, tend to be easily deteriorated by a component such as water, $CO_2$, $O_2$ or the like (hereinafter referred to as a foreign component), which is one of the reasons that prevent the EL elements from having a longer life. Consequently, in order to make the contact with an ambient air less, the elements have hitherto been used in the state of an EL panel in which they are sealed.

As the state in which the element is sealed, a hollow-type sealing in which only an outer periphery of an EL element sandwiched between a substrate and a sealing plate is sealed with a sealing layer (resin layer) including a resin or the like is known, and such hollow-type EL panels are disclosed in Japanese Patent Application Laid-Open No. 2005-91874, and the like. According to this publication, in order to prevent the travel of the foreign component in the resin layer, the EL panel is added with layered (flat) fillers.

Alternatively, as a state of sealing are known a hollow-type sealing in which only an outer periphery of an EL element sandwiched between a substrate and a sealing plate is sealed with a sealing agent (adhesive) including a resin or the like, and a solid sealing in which a whole area of an EL element sandwiched between a substrate and a sealing plate is filled with a curable resin to produce an adhesive layer is known. The hollow-type EL panels and the solid sealing-type EL panel are disclosed in Japanese Patent Application Laid-Open No. 2002-260849, and Japanese Patent Application Laid-Open No. 11-224772, respectively. In the EL panels shown in the publications, projections and depressions are formed on a sealing plate or an extraction electrode part to try to improve adhesion between the sealing plate or extraction electrode part and a substrate. In the resin layer sandwiched between the substrate and the sealing plate at its top and bottom sides, the foreign component travels predominantly in an orthogonal direction in relation to a thickness of the resin layer, namely a surface direction of the substrate. As to the resin layer of the above-mentioned conventional EL panel, when it is coated on the substrate or it is elongated with pressure between the substrate and the sealing plate, the adhesive flows in a surface direction of the substrate, whereby the fillers contained in the resin layer lie in the surface direction of the substrate. In other words, the fillers run in a line parallel to the surface of the substrate, in which direction the foreign component travels predominantly, whereby an effect for inhibiting the travel of the foreign component is very low, and lives of the EL panels cannot be sufficiently extended.

SUMMARY OF THE INVENTION

The present inventors have repeated their studies in order to prolong the lifetime of EL panels even more; and as a result, they have found a novel technique which can realize the extension of the EL panels' lives by effectively delaying the travel of a foreign component That is, the present invention has been made to solve the above-mentioned problems, and aims at providing EL panels having prolonged lives.

An EL panel according to the present invention is characterized by comprising a substrate; an EL element formed on the substrate; a sealing plate facing the substrate and covering the EL element on the substrate; and a resin layer interposed between the substrate and the sealing plate and containing multiple plate-shaped or needle-shaped fillers, wherein at least a part of the multiple fillers are the standing fillers that stand toward a surface of the substrate in a cross-section of the resin layer vertical to the substrate.

In this EL panel, a least a part of the multiple fillers added to the resin layer are standing fillers. Since the standing fillers effectively inhibit the travel of the foreign component in the surface direction of the substrate, a longer life of the EL panel can be realized.

Further, it is preferable that the standing fillers are contained in a content of 50% or more based on the all of the multiple fillers. The present inventors have found that, in this case, the life of the EL panels can be markedly improved.

An EL panel according to the present invention is characterized by comprising a substrate; an EL element formed on the substrate; a sealing plate facing the substrate and covering the EL element on the substrate; and an adhesive interposed between the substrate and the sealing plate and containing a filler having a plate-shaped or needle-shaped part, wherein a projection and depression part is formed on at least either of at least a part of a contact area of the substrate with the adhesive, and at least a part of a contact area of the sealing plate with the adhesive, and at least a part of the plate-shaped or needle-shaped part of the filler in the adhesive is inserted into a depression part of the projection and depression part.

In this EL panel, at least a part of the plate-shaped or needle-shaped part of the filler added to the adhesive is inserted into the depression part of the projection and depression part formed on at least either of the substrate and the sealing plate. Because of this structure, the plate-shaped or needle-shaped part of the filler runs in a line in a direction intersecting to the surface direction of the substrate, thus resulting in effective inhibition of travel of a foreign component in a surface direction of the substrate, whereby this EL panel is intended to have a longer life.

It is preferable that the projection and depression part is formed on both of the substrate and the sealing plate, and at least a part of the plate-shaped or needle-shaped part of the filler in the adhesive is inserted into the depression part of at least either of the two projection and depression parts. In this case, since a larger amount of the plate-shaped or needle-shaped parts of the fillers run in a line in the direction intersecting to the surface direction of the substrate, more effective results for making the life longer can be obtained.

In addition, only a part of the plate-shaped or needle-shaped part of the filler may be inserted into the depression part of the projection and depression part.

BRIEF DESCRIPTION OF THE DRAWINGS

FIG. 15 is a Table showing measurement results obtained in Example 2; and

DESCRIPTION OF THE PREFERRED EMBODIMENTS

Now, the most preferable embodiments when working the present invention will be described in detail with reference to the accompanying drawings. The same numbers are given to the same or similar structure members, and when the explanations thereof overlap, the later explanations are omitted.

First Embodiment

Figure 1:
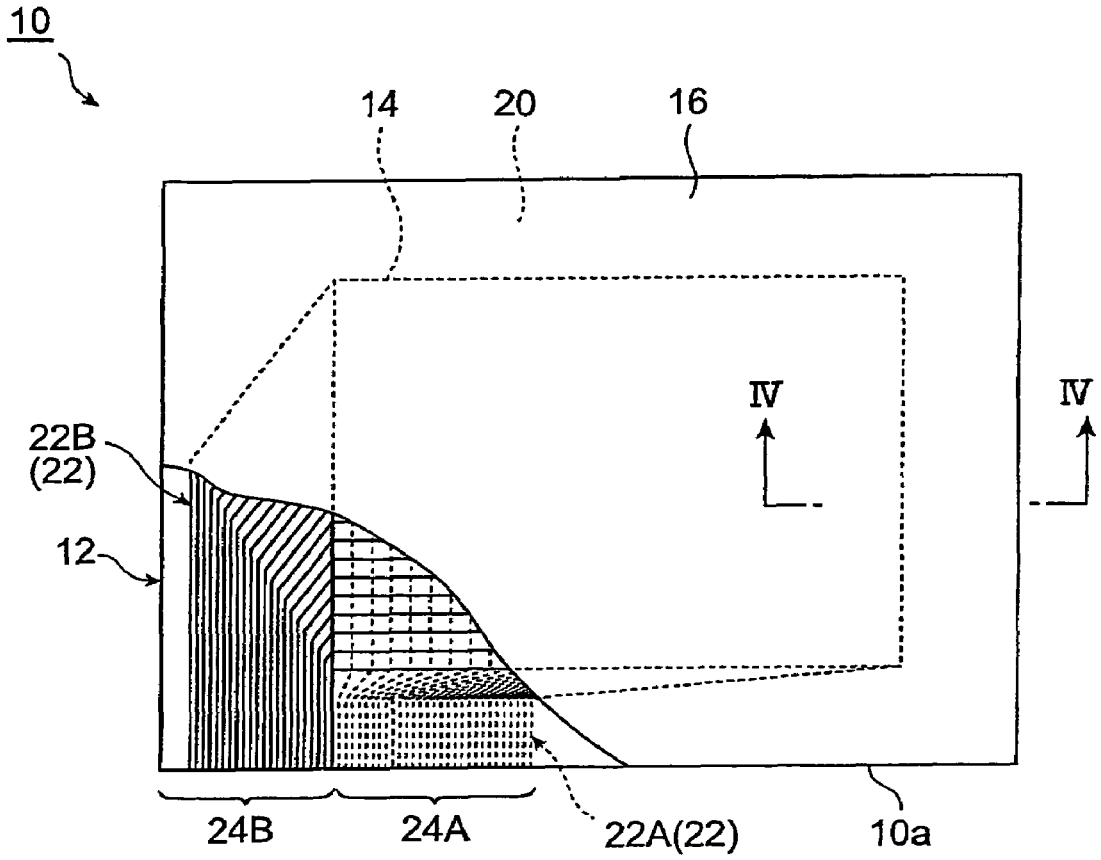
FIG. 1 is a partially cross-sectional plain view showing an EL panel according to a first embodiment of the present invention.
Figure 2:
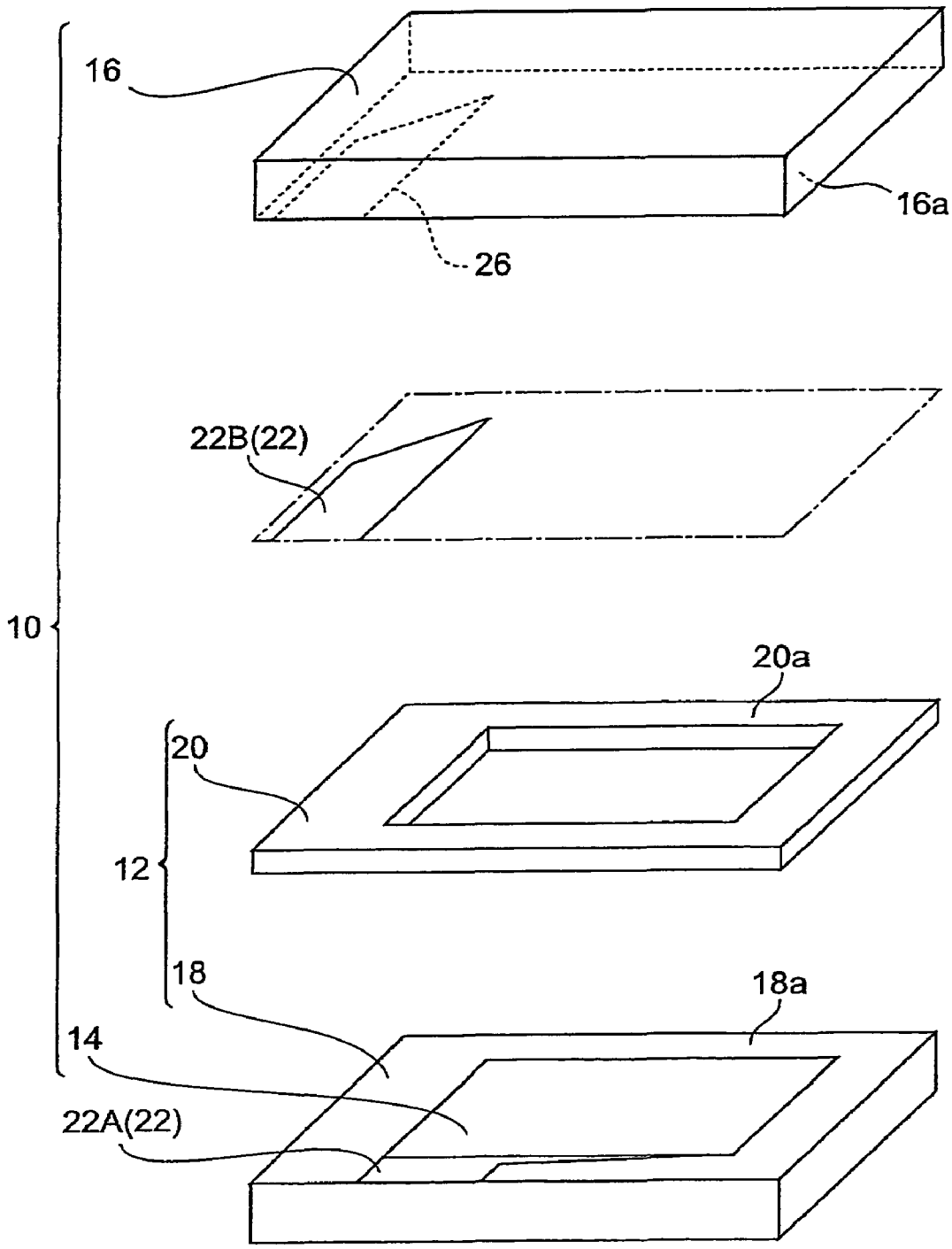
FIG. 2 is an exploded perspective view of the EL panel shown in FIG. 1.
Figure 3:
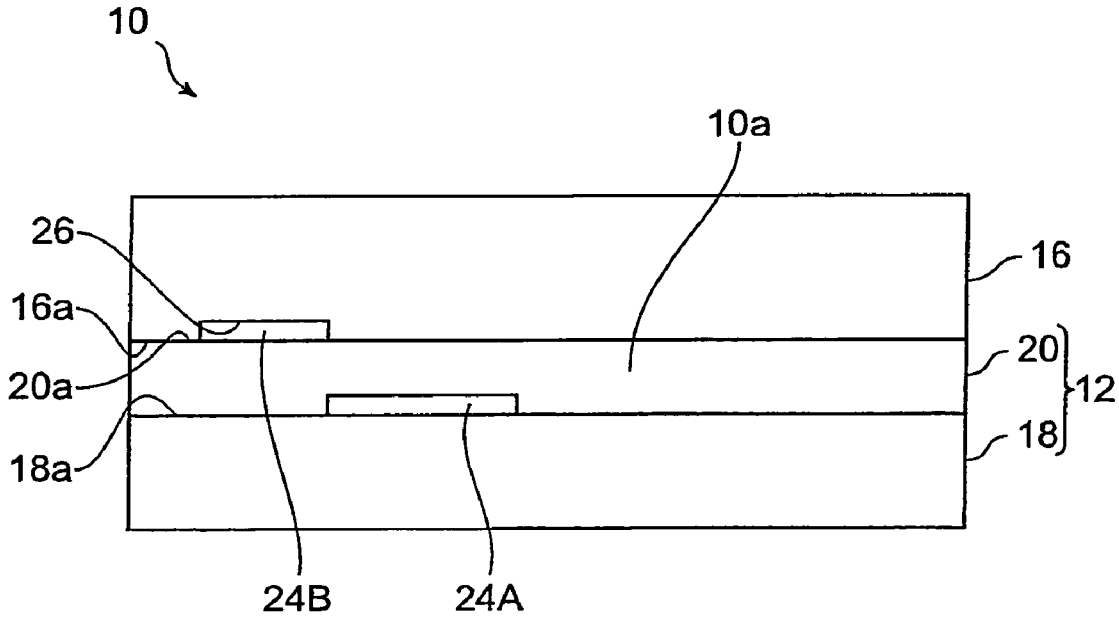
FIG. 3 is an end view of the EL panel shown in FIG. 1.

As shown in FIGS. 1 to 3, an EL panel 10 according to a first embodiment of the invention comprises a substrate 12, an EL element 14, and a sealing plate 16; and the substrate 12 is composed of a substrate 18 for forming the element and an insulating film 20.

This EL panel 10 can be applied to both of a top emission type and a bottom emission type. When the EL panel 10 is used as the bottom emission type, at least the substrate 18 for forming the element of the substrate 18 for forming the element and the sealing plate 16 is composed of a light-transmissive plate. On the other hand, when the EL panel 10 is used as the top emission type, at least the sealing plate 16 of the substrate 18 for forming the element and the sealing plate 16 is composed of a light-transmissive plate. The light-transmissive plate has a light transmission property (or is transparent), which is made of a material having a light transmission property such as glasses or plastics.

The EL element 14 has, for example, a rectangular shape having a thickness of about several hundreds nm, which is formed on a main surface 18*a* of the substrate 18 for forming the element. This EL element 14 has a laminate structure in which an EL layer is sandwiched between a positive electrode layer and a negative electrode layer. The EL layer may be made of an organic EL material or an inorganic EL material. The insulating film 20 is also formed on the main surface 18*a* of the substrate 18 for forming the element, and it has, for example, a quadrangular shape having a thickness about several μm so as to surround around the EL element 14.

On the substrate 12, a wiring 22 for driving the EL element 14 is formed. This wiring 22 comprises an positive wiring 22A which sends a drive signal to an positive electrode layer line of the EL element 14, and a negative wiring 22B which sends a drive signal to a negative electrode layer line of the EL element 14, and has a thickness of about several hundreds nm. The positive wiring 22A is drawn from one long side of the EL element 14, and the negative wiring 22B is drawn from one short side of the EL element 14. The positive wiring 22A and the negative wiring 22B are connected to drive circuits (not shown) through a positive-drawing part 24A and a negative-drawing part 24B, respectively, of one edge face 10*a* of the EL panel 10. As shown in FIG. 2, the positive wiring 22A is formed on the substrate 18 for forming the element, and the negative wiring 22B is formed on the insulating film 20.

The sealing plate 16 has a plate shape, and is formed so as to face the main surface 18*a* (the surface on which the EL element 14 is formed) of the substrate 18 for forming the element in parallel, and to cover the EL element 14 on the substrate 18 for forming the element. On the bottom surface 16*a* of this sealing plate 16 (the surface facing the substrate 12), a depression part 26 for housing the negative wiring 22B having a depth that is the same height as the negative wiring 22B is formed at an area corresponding to the negative wiring 22B (electrode wiring) formed on the substrate 12, whereby an incident in which the sealing plate 16 is tilted by the negative wiring 22B is avoided.

Figure 4:
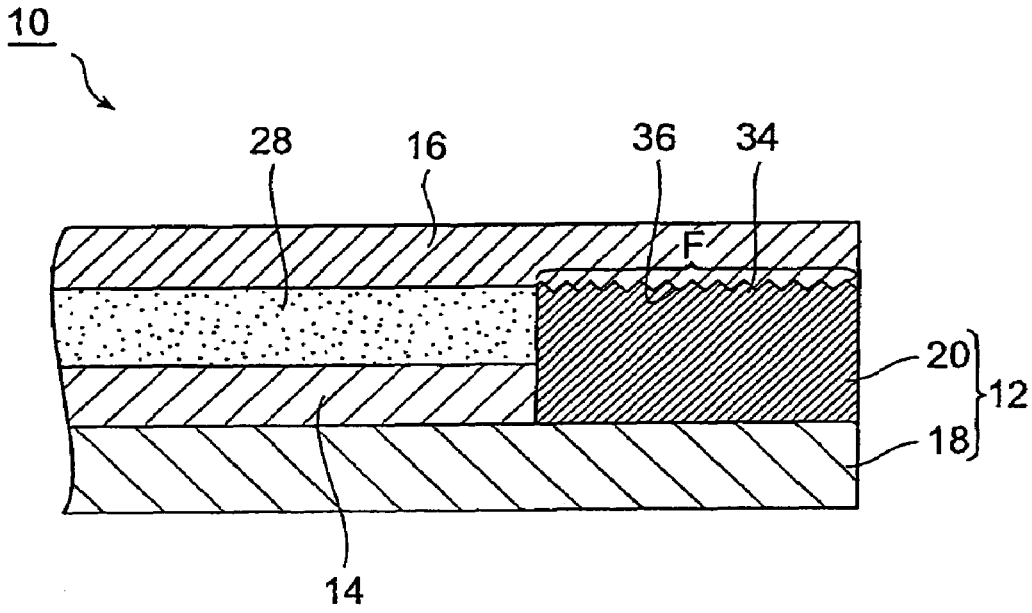
FIG. 4 is a sectional view along the line IV-IV of the EL panel shown in FIG. 1.
Figure 5:
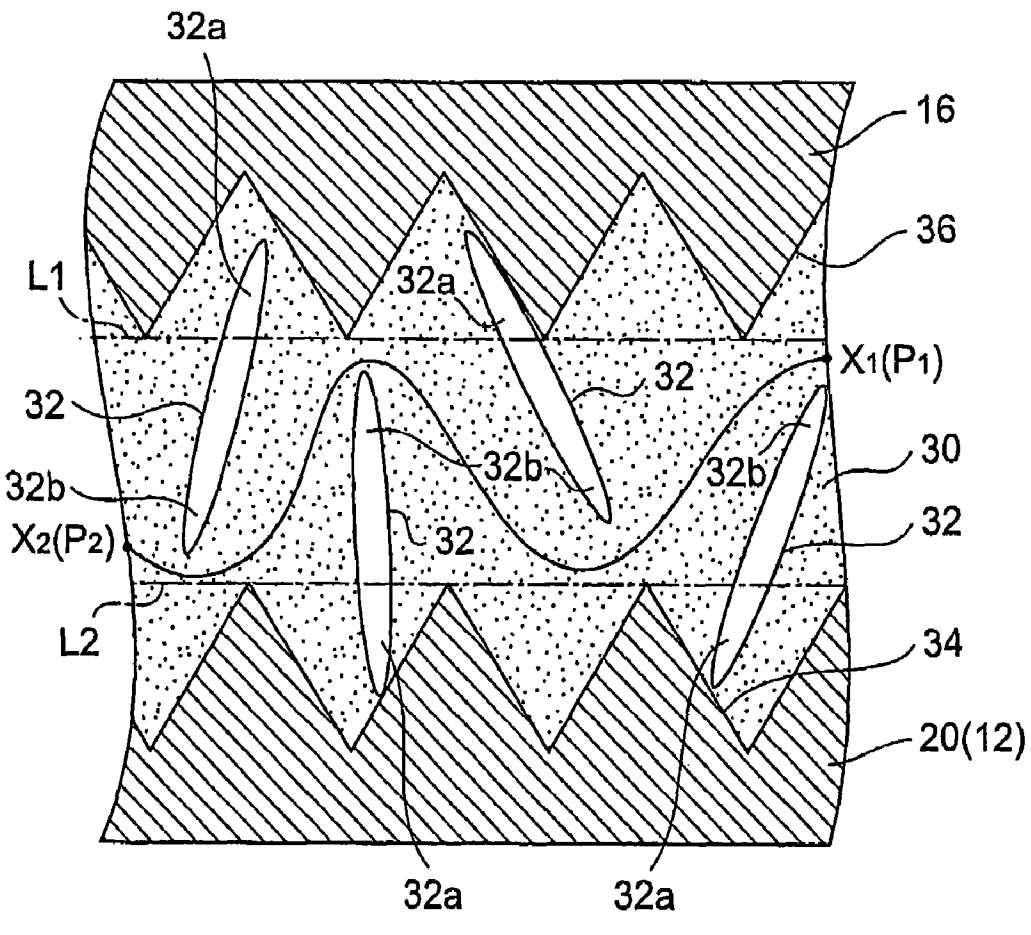
FIG. 5 is a view showing a traveling route of a foreign component in the two projection and depression parts.

As shown in FIG. 4, an adhesive 28 is interposed between the substrate 12 and the sealing plate 16, and it is completely filled in the space between the substrate 12 and the sealing plate 16. The adhesive 28, as shown in FIG. 5, comprises a resin 30 to which multiple fillers 32 are added. Epoxy resins, silicone resins, and the like may be used as the resin 30 for the adhesive 28. The whole shape of the filler 32 added to the adhesive 28 is a needle shape or a long flat shape, and has an average length of, for example, about 1 to 40 μm. The filler 32 is composed of a clay mineral such as talc, smectite or mica, glass, or the like.

The adhesive 28 is spread on the whole area of the substrate 12 (namely, the total of the surface of the substrate 18 for forming the element and the surface of the insulating film 20). That is, the adhesive 28 is placed not only within a frame of the insulating film 20 but also on a top surface 20*a* of the insulating film 20.

Projection and depression parts 34 and 36 are formed on the whole area of the top surface 20*a* of the insulating film 20 on the substrate 12 and the whole area of the bottom surface 16*a* of the sealing plate 16, respectively. The projection and depression parts 34 and 36 have a surface roughness Ra of, preferably 100 nm or more, more preferably 500 nm or more. Such projection and depression parts 34 and 36 can be formed by using a known sand blast or etching, and a mask pattern having a pre-determined shape may be used as occasion demands.

Figure 6:
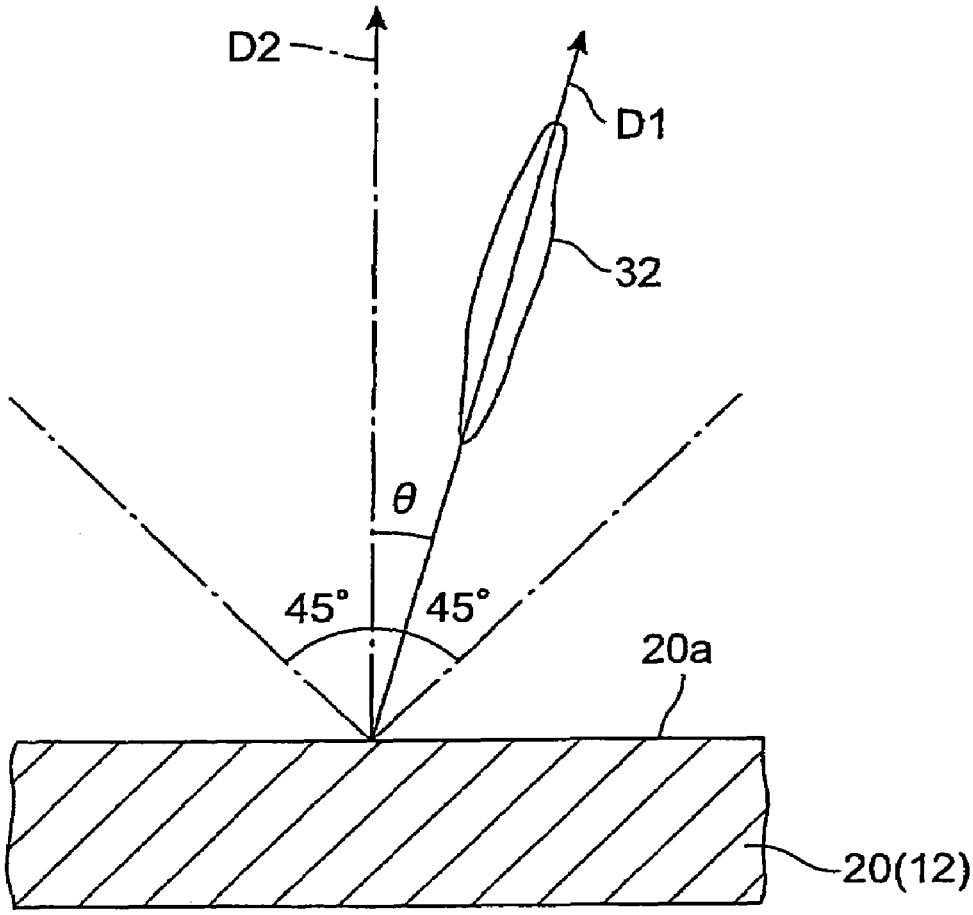
FIG. 6 is a view showing a standing filler.

In an area F where the projection and depression part 34 on the substrate 12 faces the projection and depression part 36 on the sealing plate 16, as shown in FIG. 5, almost all of the fillers 32 in the adhesive 28 stand on the substrate surface 12*b*, in other words, they are standing fillers. Here, the standing filler refers to, as shown in FIG. 6, a filler which is oriented at an angle of 45° or less from the normal line (or its datum plane) to the top surface 20*a* of the insulating film 20 on the substrate 12. More specifically, in the cross-section of the adhesive perpendicular to the substrate 12 (namely, the cross-section of the adhesive 28 in the thickness direction), if a filler has an angle (orientation angle) θ made by a line running in a direction of the filler (the direction D1 in FIG. 6) and the normal line of the substrate 12 (i.e., the insulating film 20) (a line in the direction D2 in FIG. 6, or the thickness direction of the adhesive 28) of ± not more than 45°, such a filler is a standing filler.

The above-mentioned EL panel 10 may be produced as follows: First, the EL element 14, the wiring 22 and the insulating layer 20 are formed in a pre-determined procedure on the substrate 18 for forming the element, thereby obtaining the substrate 12 on which the EL element 14 is formed. Next, a pre-determined amount of an adhesive 28 having a viscosity of about 10 Pa sec or less is placed on the substrate, and then the sealing plate 16 is faced the substrate 12 and is put over the EL element 14 to cover it Then, the substrate 12 and the sealing plate 16 are pressed with force from the sealing plate 16 side to bond the sealing plate 16 to the substrate 12. Finally, the adhesive 28 is cured (e.g., cured with light) to obtain the EL panel 10.

Here, a conventional method for producing an EL panel will be described with reference to FIG. 7. According to a conventional production method of an EL panel, fillers 32 contained in an adhesive 28 placed on an insulating layer 20A of a substrate 12A are in a state in which some degree of isotropy is kept, and each is randomly oriented (see part (a) of FIG. 7). When a sealing plate 16A is pressed with force to a substrate 12, then the adhesive 28 flows in a surface direction of the substrate 12A. In the conventional method, since the above-mentioned projection and depression parts 30 and 32 are not formed on the insulating film 20A and the sealing plate 16A (they have flat surfaces), when the adhesive 28 flows, the fillers 32 contained in the adhesive are oriented parallel to the surface of the substrate 12A along the direction of flow of the adhesive 28 (see part (b) of FIG. 7).

Figure 8:
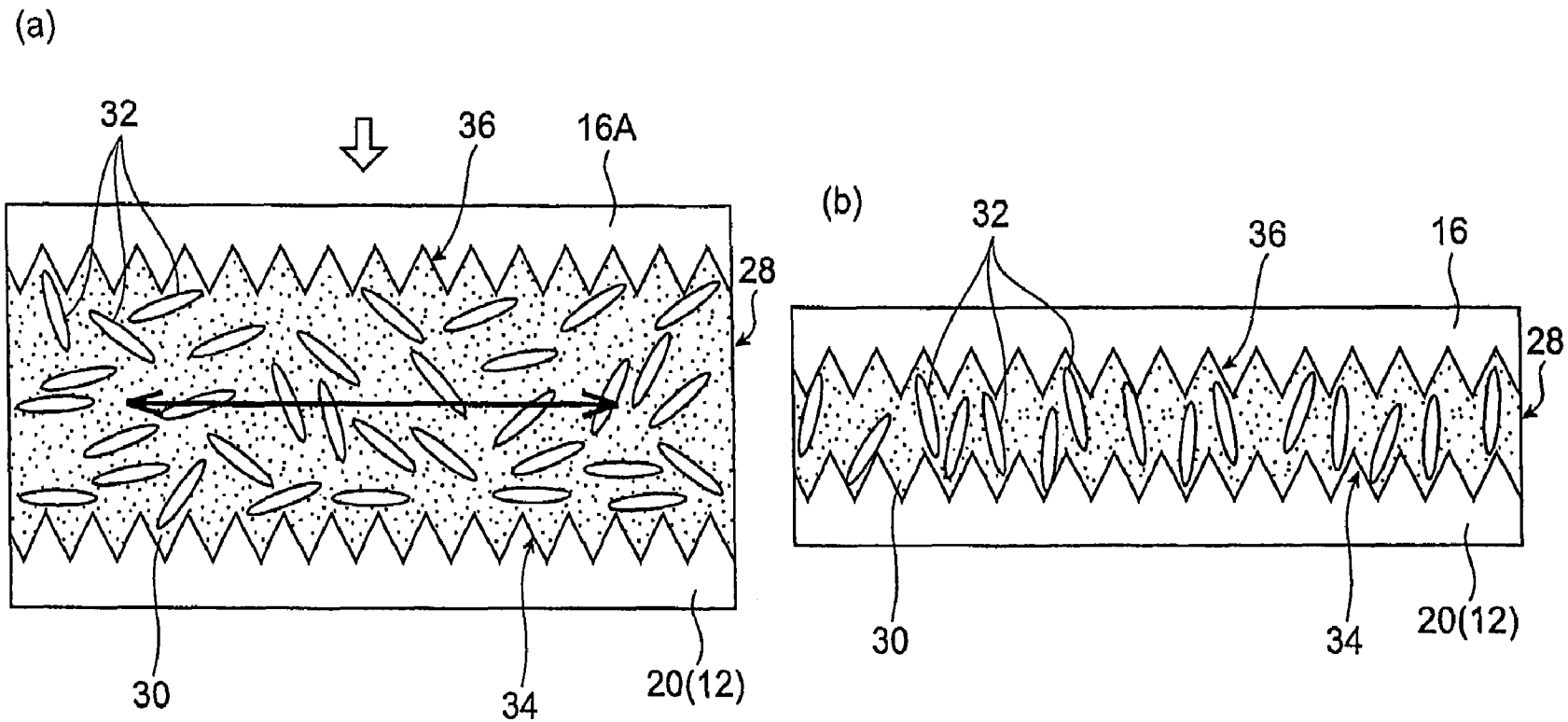
FIG. 8 is a view explaining a method for producing the EL panel shown in FIG. 1.

Subsequently, a method for producing the EL panel 10 according to the first embodiment will be described with reference to FIG. 8. The fillers 32 in the adhesive 28 which is placed on the insulating layer 20 of the substrate 12 are, similarly to the conventional method, in a state in which some degree of isotropy is kept, and each is randomly oriented (see part (a) of FIG. 8). When the sealing plate 16 is pushed to the substrate 12 and the adhesive 28 is fluidized in the surface direction of the substrate 12, then the fillers 32 contained in the adhesive 28 are not oriented parallel to the surface of the substrate 12, but, while moving, they are brought into contact with the projection parts of the projection and depression parts 34 and 36 formed on the under side and the upper side, respectively, of the adhesive 28, whereby they change their pose (namely their orientation directions) (see part (b) of FIG. 8). Then, only the one end 32*a* is inserted into the depression part of the projection and depression part 34 or 36 to form a standing filler. In the standing filler, as shown in FIG. 5, the one end 32*a* is located closer to the projection and depression part 34 or 36 side than an imaginary line L1 or L2, connecting adjacent projection tips of the projection and depression part 34 or 36, and the other end 32*b* is located at the counter side of the above-mentioned projection or depression part 34 or 36, crossing the imaginary line L1 or L2.

Next, a mechanism for displacing the foreign component by the fillers contained in the adhesive 28 will be described with reference to FIG. 5. Specifically, a case where the foreign component travels from a position $X_1$ to an arbitrary position $X_2$ in the adhesive 28 in the direction X (the surface direction of the substrate 12) in FIG. 5 will be described. In this case, the direction X is the most dominant traveling direction of the foreign component in the adhesive 28 sandwiched between the substrate 12 and the sealing plate 16. The position $X_1$ is, for example, a position of an edge face of the adhesive 28, and the position $X_2$ is, for example, an inside position from the edge face of the adhesive 28 at a pre-determined distance. The foreign component used herein includes water, $CO_2$, $O_2$, and the like, which gives bad influence to element characteristics of the EL element 14.

In the case where the fillers 32 in the adhesive are standing fillers, when the foreign component travels from the position $X_1$ in the direction X, their travel is inhibited by the fillers 32 running in a line in the cross direction of the direction X, whereby the foreign component snakes in a direction Y (an orthogonal direction in relation to the direction X, or a thickness direction of the adhesive 28) so as to bypass the fillers 32, and reaches a point $P_2$ on a position $X_2$. Consequently, the traveling route of the foreign component in the adhesive 28 in the EL panel 10 is remarkably extended.

Figure 7:
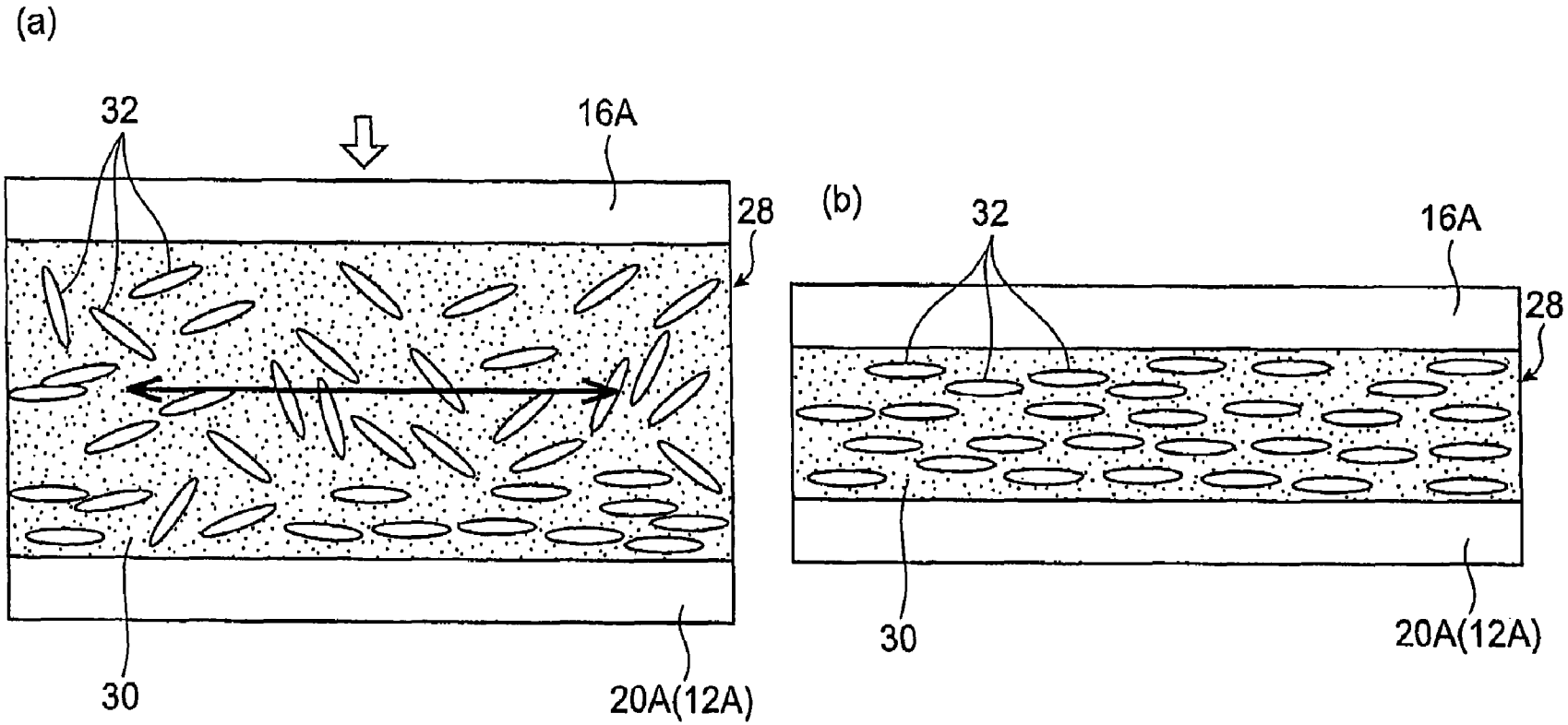
FIG. 7 is a view explaining a conventional method for producing an EL panel.

On the other hand, according to the conventional method, the fillers 32 running in a line in the surface direction of the substrate 12A (see part (b) of FIG. 7), in other words, they run in a line in the direction X which is the most predominant traveling direction of the foreign component. Consequently, the fillers 32 hardly prevent the travel of the foreign component, and the traveling route of the foreign component hardly snakes, accordingly. In other words, the foreign component goes almost straight from the position $X_1$ to the position X2. As a result, in this case, the effect for inhibiting the travel of the foreign component by the fillers is very low, and accordingly the life of the EL panel cannot be sufficiently extended.

As mentioned above in detail, in the EL panel 10 produced by means of the above-mentioned production method, the route of the foreign component traveling in the adhesive 28 is remarkably extended compared with the EL panel produced by means of the conventional method. As a result, the sufficiently longer life of this EL panel 10 is realized.

As mentioned above, according to the present invention, the EL panels having a longer life are provided.

The projection and depression part 34 formed on the insulating film 20 and the projection and depression part 36 formed on the sealing plate 16 are not necessarily formed on the whole areas thereof, and may be partially formed. Specifically, even if the projection and depression parts 34 and 36 are partly formed in the contact area with the adhesive 28, the fillers 32 easily stand at least in the projection and depression parts 34 and 36, and, as a result, the foreign component travels in a lower speed, and the EL panel 10 can have a longer life. Also, both of the projection and depression parts 34 and 36 are not necessarily formed, and either of the projection and depression parts 34 and 36 may be formed as occasion demands, from the same reasons as above. However, when both of the projection and depression parts 34 and 36 are formed, then a larger amount of the fillers 32 easily stand, and therefore the EL panel can have a longer life more effectively.

In order to adjust a viscosity of the adhesive 28, the substrate 12 may be bound to the sealing plate 16 with heating.

Although the above-mentioned first embodiment shows the solid sealing-type EL panel structure wherein the space between the substrate 12 and the sealing plate 16 is filled with the adhesive 28, the panel structure may be formed into a gas-sealing type (hollow-type) EL panel structure wherein a space between the substrate 12 and the sealing plate 16, in which the EL element 14 is placed, is hollow. That is, an embodiment wherein the adhesive 28 is not placed in the frame of the insulating film, but is placed at only a part where the insulating film 20 contacts with the sealing plate 16 may be worked. In this case, since the fillers 32 also easily stand at the projection and depression parts 34 and 36, the foreign component travels in a lower speed, and a period of time taken to reach the inside space of the EL panel for the foreign component is prolonged, and a longer life of the EL panel is realized.

Figure 9:
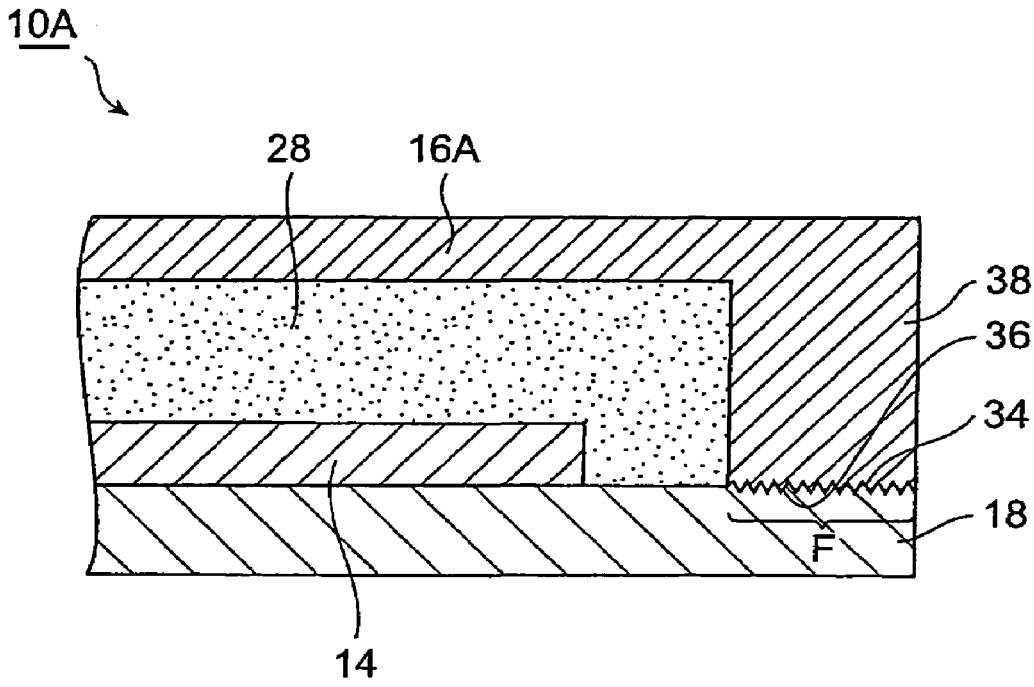
FIG. 9 is a view showing another embodiment of an EL panel.

In addition, the EL panel 10 may be changed to an EL panel 10A using no insulating film 20, as shown in FIG. 9. Specifically, the sealing plate 16 is changed to a sealing plate 16A having a section 38 which is bent toward the substrate 12 at an outer edge position thereof In this case, a projection and depression part 36 formed on the under surface of the bend section 38 of the sealing plate 16 is brought into contact with a projection and depression part 34 formed on the substrate 18 for forming the element. In this case, the same effects as above can be obtained; that is, the fillers 32 easily stand between the projection and depression parts 34 and 36, and therefore the foreign component travels in a lower speed, whereby a longer life of the EL panel 10A is realized.

Further, the fillers 32 are not necessarily plate-shaped or needle-shaped, and may have a shape having partially plate-shaped part or needle-shaped part. In this case, at least a part of the plate-shaped part or needle-shaped part is inserted into the depression parts of the projection and depression parts 34 and 36, whereby, as mentioned in the above-mentioned first embodiment, the traveling route of the foreign component in the adhesive 28 is remarkably extended, and a very longer life can be obtained.

EXAMPLE 1

Now, the first embodiment of the present invention will be described, using Example 1.

The present inventors produced an EL panel which was almost the same as the EL panel 10 of the above-mentioned first embodiment by the following procedure. In the EL panel, a surface roughness of projection and depression parts on a substrate and a sealing plate was 100 nm or more, and an average length of fillers added to an adhesive was 4.2 μm.

First, after an adhesive having a viscosity of 5 Pa sec was put on a substrate using a dispenser, a sealing plate is put over an EL element to cover it. Then, the substrate and the sealing plate were pressed with a force of 0.4 MPa from the sealing plate side at a temperature of 60° C. for 15 minutes to bond the sealing plate 16 to the substrate 12 with a gap of 11 μm. After that, the adhesive was cured with light.

By the observation of the cross section of the produced EL panel with SEM, it was confirmed that one ends of the fillers were inserted into the depression parts of the projection and depression part.

Second Embodiment

Figure 10:
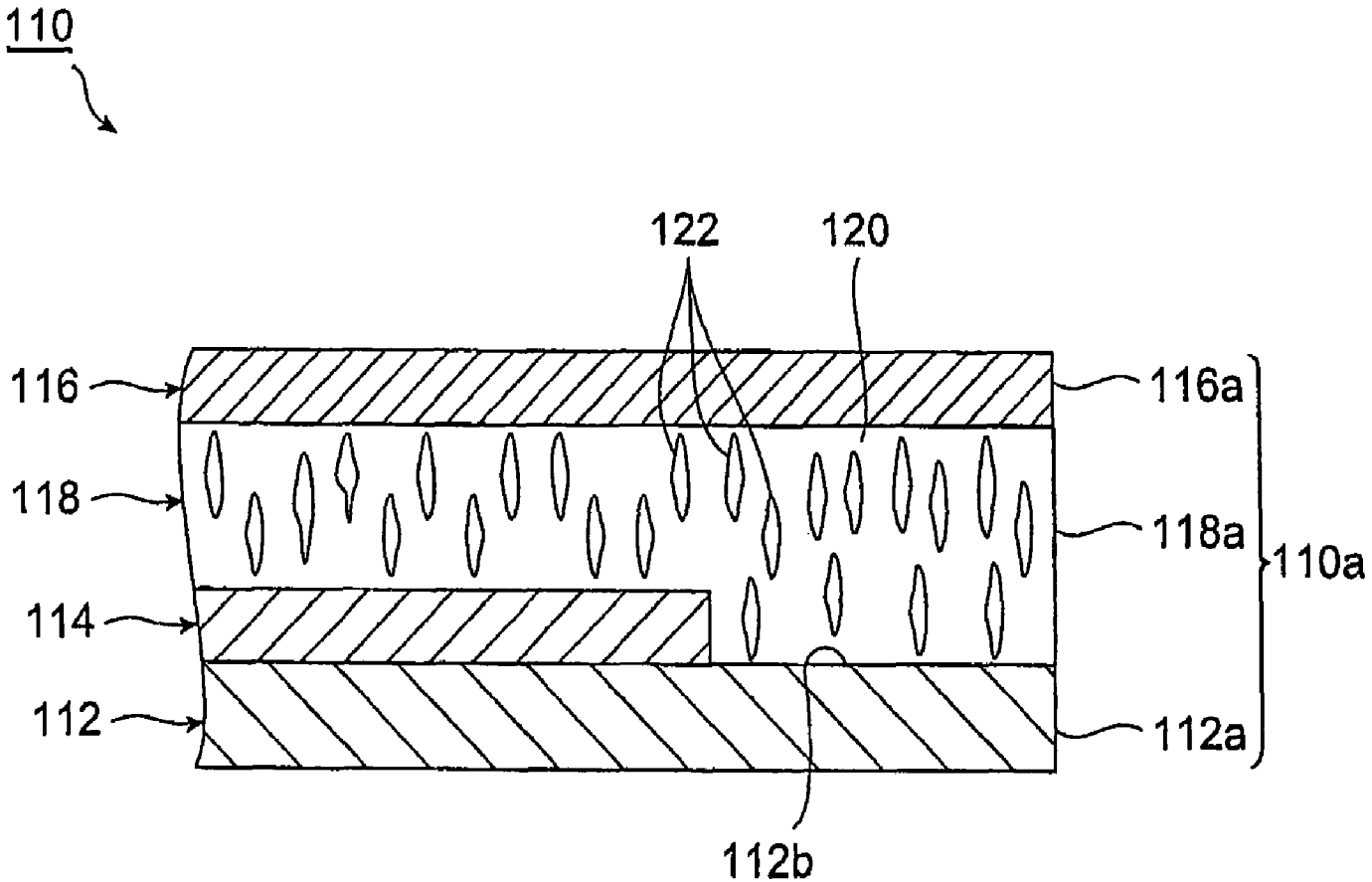
FIG. 10 is a schematic sectional view showing an EL panel according to a second embodiment of the present invention.

An EL panel 110 according to a second embodiment of the present invention comprises, as shown in FIG. 10, a substrate 112, an EL element 114, a sealing plate 116, and a resin sheet 118.

This EL panel 110 can be applied to either a top emission type or a bottom emission type. When the EL panel 110 is used as the bottom emission type, at least the substrate 112 of the substrate 112 and the sealing plate 116 is composed of a light-transmissive plate. On the other hand, when the EL panel 110 is used as the top emission type, at least the sealing plate 116 of the substrate 112 and the sealing plate 116 is composed of a light-transmissive plate. The light-transmissive plate has a light transmission property (or is transparent), which is made of a material having a light transmission property such as glasses or plastics.

The EL element 114 is formed on the substrate 112, and has a laminate structure in which an EL layer is sandwiched between a pair of electrode layers. This EL layer may be made of an organic EL material or an inorganic EL material. The sealing plate 116 is formed so as to face the surface of the EL element 114 on the substrate 112 in parallel, and to cover the EL element 114 on the substrate 112.

The resin sheet 118 is interposed between the substrate 112 and the sealing plate 116, and acts as a resin layer which binds the substrate 112 to the sealing plate 116. A space between the substrate 112 and the sealing plate 116 is completely filled with the resin sheet 118, without any empty space. Here, since the EL element 114 is formed at an inner position from the edge face 116*a* of the sealing plate 116 at a predetermined distance on an edge face 10*a* of the EL panel 110, an edge face 116*a* of the sealing plate 116, an edge face 112*a* of the substrate 112, and an edge face 118*a* of the resin sheet 118 are exposed, but the EL element 114 is not exposed.

Figure 11:
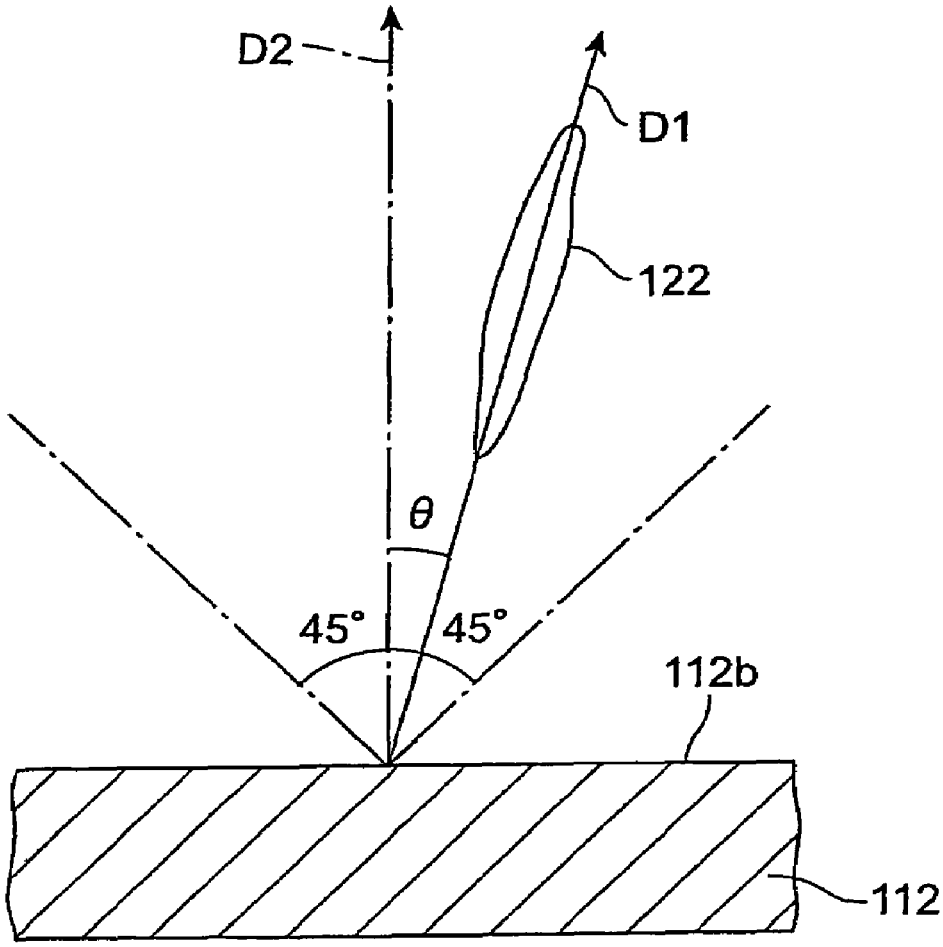
FIG. 11 is a view showing a standing filler.

The resin sheet 118 is composed of a sheet-shaped resin 120 in which multiple fillers 122 are contained. As the resin 120 for this resin sheet 118, epoxy resins, silicone resins and the like may be used. The fillers 122 added to the resin sheet 118 have a needle shape or a long flat shape, and all of them are standing fillers which stand to the substrate surface 12*b*. Here, the standing filler refers to a filler which is oriented at an angle of 45° or less from the normal line of the substrate. More specifically, in the cross-section of the resin sheet perpendicular to the substrate 112 (namely, the cross-section of the resin sheet 118 in the thickness direction), as shown in FIG. 11, if a filler has an angle (orientation angle) θ made by a line running in a direction of the filler (the direction D1 in FIG. 11) and the normal line of the substrate 112 (i.e., the direction D2, or the thickness direction of the resin sheet 118) of ± not more than 45°, such a filler is a standing filler. Actually, the standing fillers contained in the resin sheet 118 have an orientation angle θ near to 0°, and they run in a line approximately in the normal line direction of the substrate 112. The fillers are composed of, for example, a clay mineral such talc, smectite or mica, glass, or the like.

Next, the procedure for producing the above-mentioned EL panel 110 will be described with reference to FIG. 12. First, as shown in part (a) of FIG. 12, for preparing the resin sheet 118, a resin thin film 132 is laminated on a PET film 130 by screen printing. This resin thin film 132 has a thickness of, for example about 10 μm, and is composed of a resin in which fillers 122 are dispersed by using a mixer or a roll. Each filler 122 contained in the resin thin film 32 lies parallel to the surface of the PET film 130 upon printing. After the resin thin film 32 is laminated on the PET film 130, the film 32 is cured. Subsequently, as shown in part (b) of FIG. 12, the same resin thin film as above is laminated on the resin thin film 132 formed on the PET film 130, and the laminated resin thin film 32 is also cured. This procedure is repeated and a predetermined number of the resin thin films 132 are sequentially laminated to form a laminate 136 of the resin thin films 132 on the PET films 130 shown in part (c) of FIG. 12. Then, the laminate 136 of the resin thin films 132 obtained by separating from the PET film 130 is sliced in the laminating direction into a thickness of, for example, tens of μm, as shown in part (d) of FIG. 12, whereby a resin sheet 118 as shown in part (e) of FIG. 12 is obtained by this slicing process.

The thickness direction of the resin sheet 118 is the same direction as the surface direction of the resin thin film 132. Accordingly, each filler 122, which has run in a line parallel to the surface of the resin thin film 132, runs in a line in the thickness direction in this resin sheet 118.

Figure 12:
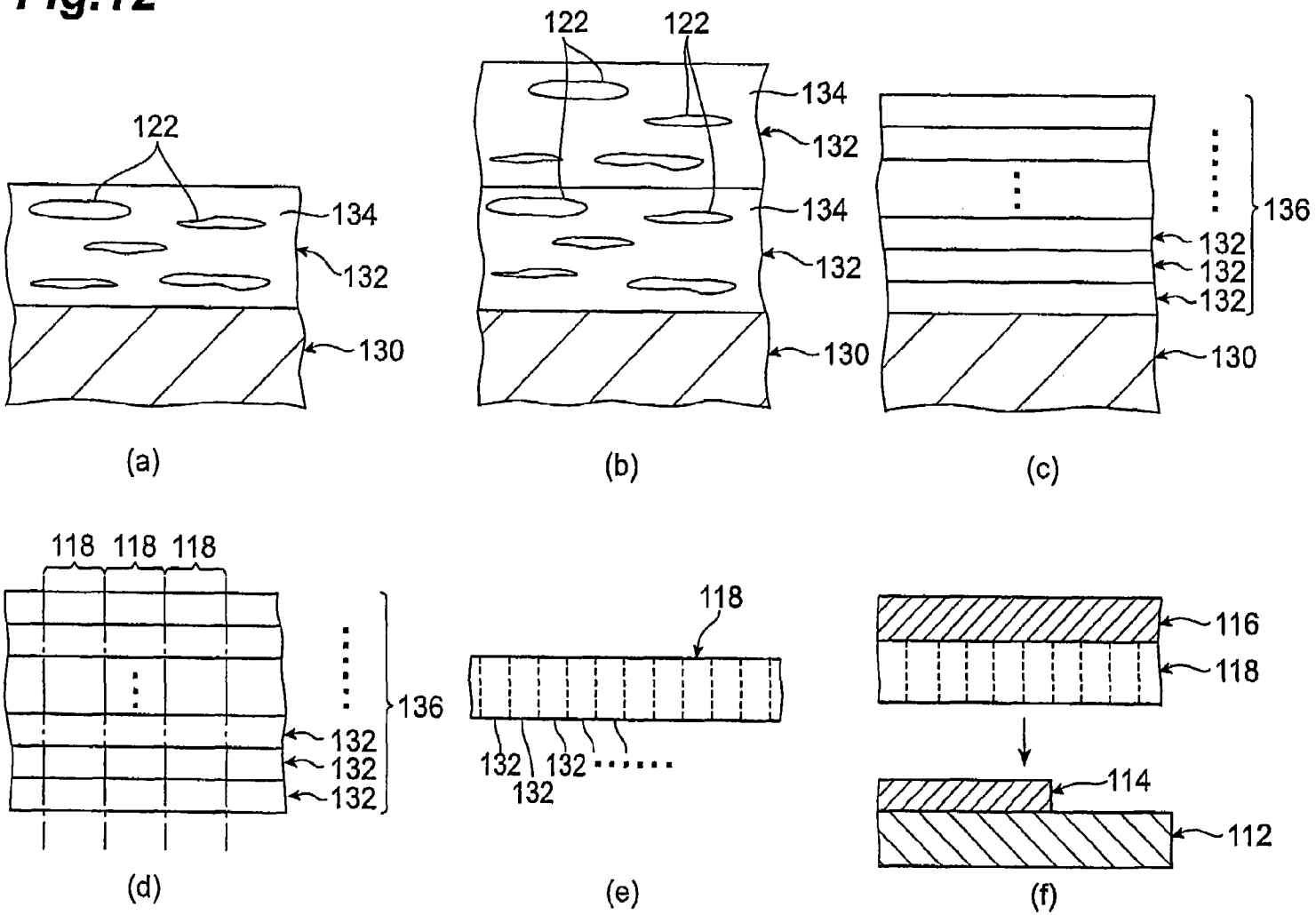
FIG. 12 is a view showing a procedure for producing the EL panel shown in FIG. 10.

Then, as shown in part (f) of FIG. 12, the thus obtained resin sheet 118 is bound to one side of the sealing plate 116, and the sealing plate to which the resin sheet 118 is bound and the substrate 112 on which the EL element 114 is formed are bound to each other such that the resin sheet side of the sealing plate 116 faces the EL element side of the substrate 112, and then the resin is completely cured, thereby completing the above-mentioned EL panel 110.

Next, a mechanism for displacing the foreign component by the fillers 122 contained in the resin sheet 118 will be described with reference to FIG. 13. Specifically, a case where the foreign component travels from a position X1 to an arbitrary position X2 in the resin sheet 118 in the direction of X (the surface direction of the substrate 112 and the resin sheet 118) in FIG. 13, will be described. The position X1 is, for example, a position of an edge face 118*a* of the resin sheet 118, and the position X2 is, for example, an inside position from the edge face 118*a* of the resin sheet 118 at a predetermined distance. The foreign component used herein includes water, $CO_2$, $O_2$, and the like, which gives bad influence to element characteristics of the EL element 114.

Figure 13:
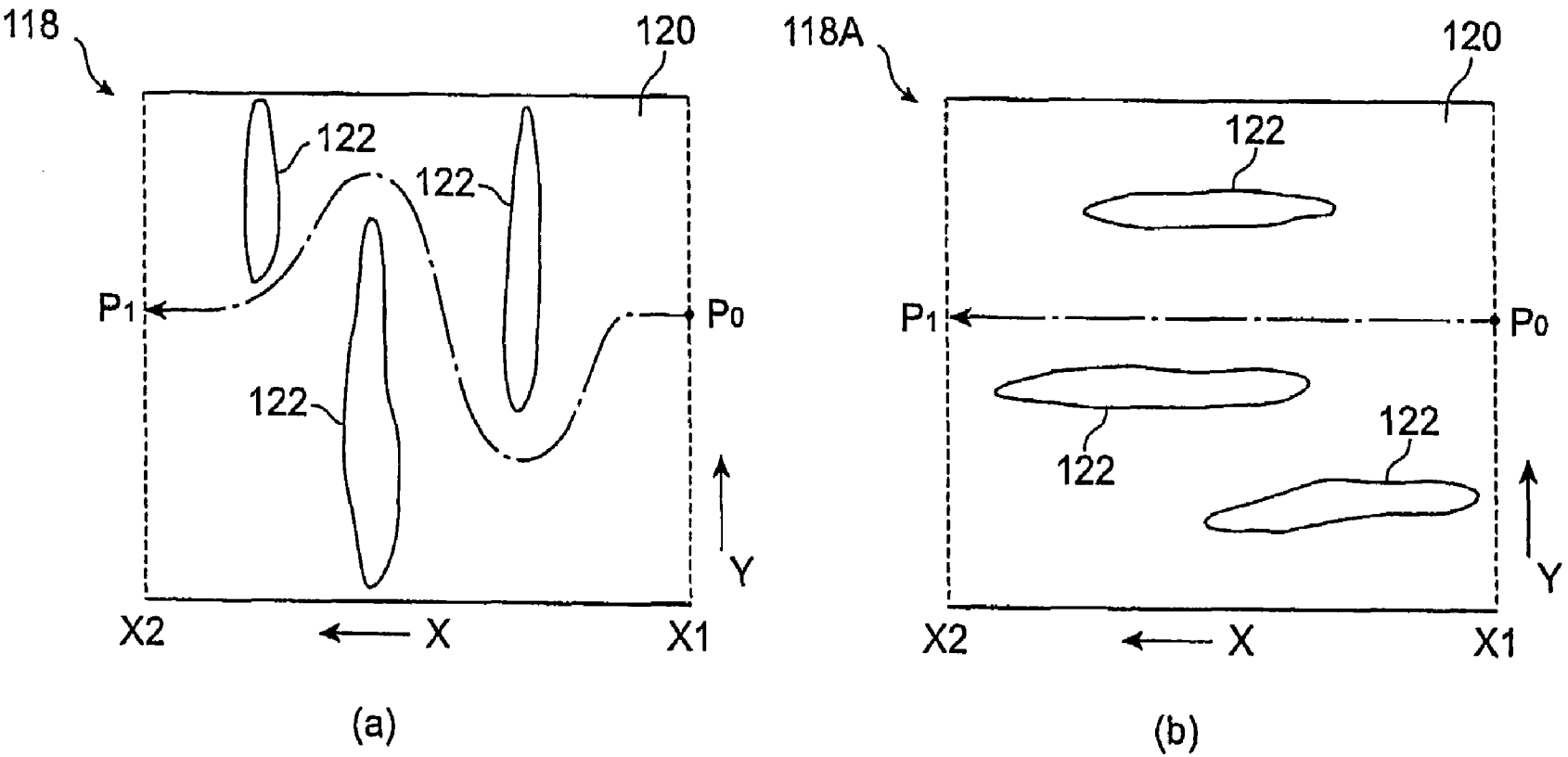
FIG. 13 is a view comparing a traveling route of the foreign component in the resin sheet of the EL panel shown in FIG. 10, with a conventional traveling route of a foreign component.

As shown in part (a) of FIG. 13, in case where the fillers 122 in the resin sheet 118 are standing fillers, when the foreign component travels from the point $P_0$ on the position X1 in the direction X, the travel of the foreign component is inhibited by the fillers 122 running in a line in a cross direction of the direction X, whereby the foreign component snakes in a direction Y (an orthogonal direction in relation to the direction X, or a thickness direction of the resin sheet 118) so as to bypass the fillers 112, and reaches a point $P_1$ on a position $X_2$. On the other hand, in case of a conventional resin sheet 118A, as shown in part (b) of FIG. 13, since the fillers 122 run in a line in the direction X, they hardly prevent the travel of the foreign component, and the traveling route of the foreign component hardly snakes, accordingly. In other words, the foreign component goes almost straight from the point $P_0$ on the position $X_1$ to the point $P_1$ on the position X2. That is, in the resin sheet 118, the route of the foreign component traveling in the sheet is remarkably extended compared with the case using the conventional resin sheet 118 A.

As mentioned above in detail, since, in the EL panel 110, the resin sheet 118 is used as the resin layer which bind the substrate 112 to the sealing plate 116, the route of the foreign component is remarkably extended compared with the case of using the conventional technique of the EL panels, thus resulting in realizing a sufficiently long life of the EL panel 110.

As mentioned above, according to the present invention, the EL panels having a longer life are provided.

In the above-mentioned embodiment, the multiple fillers 122 contained in the resin sheet 118 are all standing fillers, but the standing fillers may be a part of the multiple fillers 122 contained in the resin sheet 118. The present inventors have found, however, that when 50% or more of the fillers 122 contained in the resin sheet 118 are standing fillers, the life of the EL panel 110 is remarkably extended.

Figure 14:
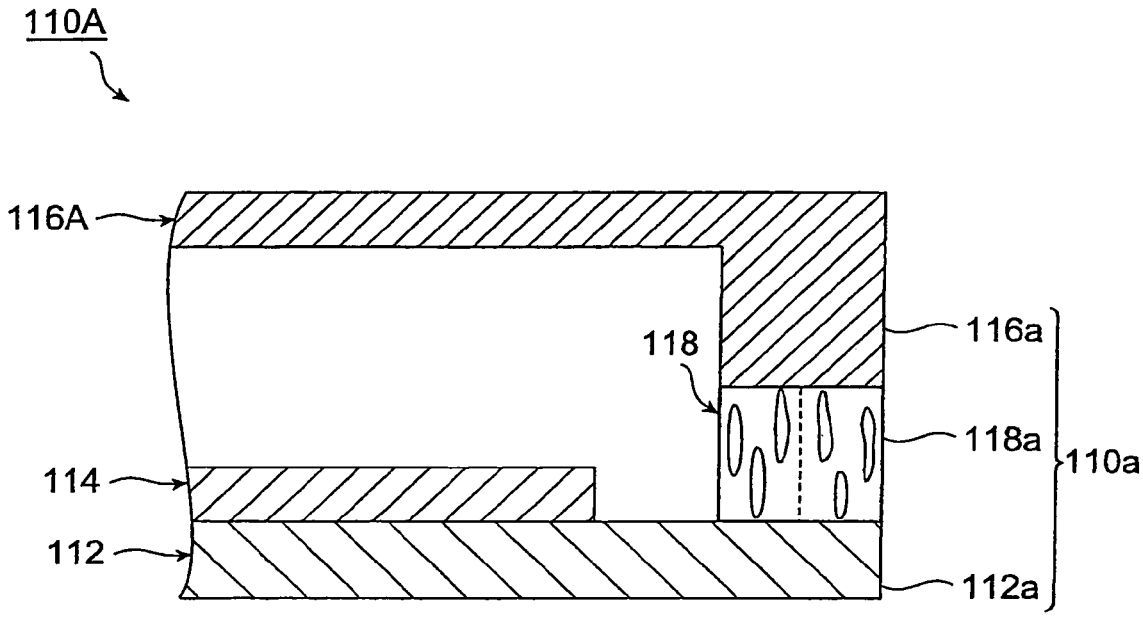
FIG. 14 is a view showing another embodiment of an EL panel.

Although the above-mentioned second embodiment shows the solid sealing-type EL panel structure wherein the space between the substrate 112 and the sealing plate 116 is completely filled with the resin sheet 118, a gas-sealing type (hollow-type) EL panel structure wherein a space between the substrate 112 and the sealing plate 116, in which the EL element 14 is placed, is hollow may be suitably used. That is, as shown in FIG. 14, as a line-shaped resin layer which binds an outer edge of the substrate 112 to an outer edge of the sealing plate 116A in the hollow-type EL panel 110A, the above-mentioned resin sheet 118 may be used. At this time, the resin sheet 118 surrounds the EL element 114 between the substrate 112 and the sealing plate 116. In this case, since the foreign component in the resin sheet 118 travels in a lower speed, a period of time taken to reach the inside space of the EL panel 110A for the foreign component is prolonged, and a longer life of the EL panel is realized.

The present invention is not limited to the above-mentioned embodiments, and various modifications can be made. For example, the orientation angle θ of the standing filler is not necessarily a value near to 0°, and it may be within the range of $0 \leqq \theta \leqq 45°$. In addition, as the resin layer which binds the substrate to the sealing plate of the EL panel, a resin slurry containing standing fillers can be used instead of the resin sheet. Even if the resin slurry is used, the same effects as obtained in the above-mentioned EL panel 110 can be obtained.

EXAMPLE 2

Now, the content of the second embodiment of the present invention will be described by means of Example 2.

In Example 2, the present inventors prepared 4 different resin sheets having only a different standing filler content, and EL panels (Sample Nos. 1 to 4) were produced using the same. Specifically, Sample Nos. 1 to 4 had standing filler contents of 47%, 53%, 72% and 88%, respectively. The standing filler contents were calculated from values obtained by observing an area of 40 μm×30 μm on the cross section of the resin sheet vertical in relation to the substrate with SEM (magnification: 2000 to 5000 times), and counting fillers having an orientation angle of 45° or less.

EL panels were produced in the similar manner as in the procedure shown in FIG. 12. That is, an epoxy resin in which fillers were dispersed with a mixer or a roll was screen-printed on a PET film having a releasing agent in a thickness of 20 μm under a nitrogen atmosphere (in a glove box) to form a resin thin film. The screen-printer was made by Newlong Machine Works. Ltd, and the screen had a mesh size of 640. After a resin thin film was formed on the whole surface of the PET film, it was allowed to stand at 60° C. for 2 hours for leveling. After that, the epoxy resin was cured by irradiating UV light. At this time, the cumulative luminous energy of UV light was within the range of 10 to 30% of the energy required for complete cure. After the irradiation with UV light, the resin thin film was separated from the PET film with a pincette, and the resulting film was folded to form a laminate having 1000 layers. In case where a laminate with a sufficient thickness could not be obtained by using one resin thin film, a desired thickness was obtained by using additional resin thin films. The laminate was sandwiched between two PET films, the laminate was sliced in a laminating direction with a cutter to give a thickness of 150 μm. The resin sheet obtained in the slicing process was bound to the pre-prepared sealing plate, which was laminated on the substrate on which the EL element was formed under a nitrogen atmosphere, and pressed it. Finally, UV light was irradiated to completely cure the resin to obtain an EL panel. After the irradiation with UV light, the panel was cured with heat at 80° C. for 1 hour for relaxation of stress.

The epoxy resin was used as the resin for the resin sheet of each Sample No. 1 to 4. The fillers added to each Sample No. 1 to 4 were layered fillers obtained by delaminating a layered clay compound into small pieces, whose average size was 5 μm (length)×3 μm (width)×2 μm (thickness). In Sample Nos. 1 to 4, the same organic EL element was formed on the substrates, and the same glass plate was used as the sealing plates.

Samples Nos. 1 to 4 were driven under the same conditions, and the brightness change with time of each EL panel was determined. The brightness was determined by applying a driving voltage of 5 V to the produced organic EL element, and measuring a luminous brightness in a front direction of light emitted from the sealing plate side with a brightness photometer (made by Otsuka Electronics Co., Ltd., MCPD-7000).

Figure 16:
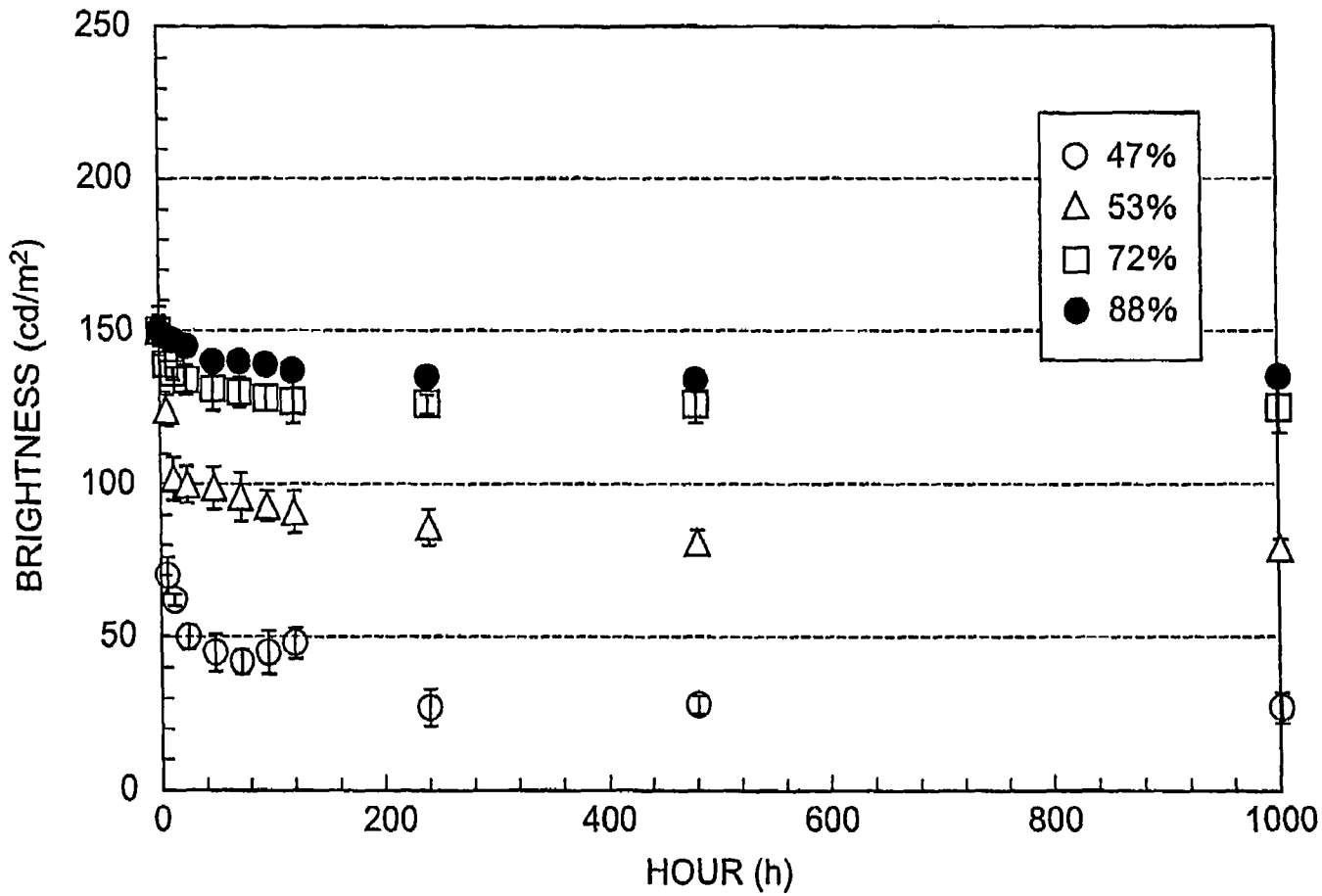
FIG. 16 is a graph showing measurement results obtained in Example 2.

The results are shown in a Table in FIG. 15 and a graph in FIG. 16. As apparent from FIGS. 15 and 16, the lowering rates of brightness after 1000 hours in Sample Nos. 2 to 4 were remarkably smaller than that in Sample No. 1. Specifically, the lowering rates of brightness of Sample Nos. 1 to 4 were 82%, 47%, 17%, and 10%, respectively. These results proved that the lives of the EL panels in Sample Nos. 2 to 4, in which the contents of the standing fillers in the resin sheet were 50% or more, were markedly extended compared with the life of the EL panel in Sample No. 1, in which the content of the standing fillers was less than 50%.

What is claimed is:

1. An EL panel comprising:

a substrate;

an EL element formed on the substrate;

a sealing plate facing the substrate and covering the EL element on the substrate; and an adhesive interposed between the substrate and the sealing plate, and containing a plurality of fillers having a plate-shaped or needle-shaped part, wherein a first projection and depression part is formed on at least a part of a contact area of the substrate with the adhesive, the first projection and depression part having a plurality of projection parts with projection tips and a plurality of depression parts, wherein a second projection and depression part is formed on at least a part of a contact area of the sealing plate with the adhesive, the second projection and depression part having a plurality of projection parts with projection tips and a plurality of depression parts, wherein a gap area is provided between the projection tips of the projection parts of the first projection and depression part and the projection tips of the projection parts of the second projection and depression part, wherein one end of the plate-shaped or needle-shaped part of the plurality of fillers is inserted in one of the plurality of depression parts of the first projection and depression part or one of the plurality of depression parts of the second projection and depression part, wherein a remaining part of the plate-shaped or needle-shaped part of the plurality of fillers is positioned within the gap area, and wherein the remaining part of the plurality of fillers overlaps each other as seen from a direction parallel to a surface of the substrate or a surface of the sealing plate.

2. The EL panel according to claim 1, wherein the plurality of fillers is composed of any one of talc, smectite, mica and glass.

3. The EL panel according to claim 1, wherein an average length of each of the plurality of fillers is about 1 to 40 μm.

4. The EL panel according to claim 1, wherein a surface roughness Ra of at least one of the first projection and depression part and the second projection and depression part is about 100 nm or more.

* * * * *